United States Patent [19]

Van Sickle

[11] 4,044,210

[45] Aug. 23, 1977

[54] FLUID-BLAST CIRCUIT INTERRUPTER

[75] Inventor: Roswell C. Van Sickle, Pittsburgh, Pa.

[73] Assignee: Westinghouse Electric Corporation, Pittsburgh, Pa.

[21] Appl. No.: 596,792

[22] Filed: July 17, 1975

[51] Int. Cl.[2] ..... H01H 33/82

[52] U.S. Cl. ..... 200/148 H; 200/144 AP; 200/145

[58] Field of Search ..... 200/146 R, 144 AP, 145, 200/148 R, 148 H

[56] References Cited

U.S. PATENT DOCUMENTS

| | | | |
|---|---|---|---|
| 2,658,128 | 11/1953 | Forwald | 200/146 R |
| 2,894,100 | 7/1959 | Hoffmann | 200/146 R |
| 3,114,816 | 12/1963 | Beatty | 200/144 AP |
| 3,291,947 | 12/1966 | Van Sickle | 200/144 AP |
| 3,538,277 | 11/1970 | Phillips | 200/144 AP |

*Primary Examiner*—Robert S. Macon
*Attorney, Agent, or Firm*—Robert E. Converse, Jr.

[57] ABSTRACT

A system for interrupting high-voltage circuits including a surge-limiting resistor, a resistor switching interrupter and a power interrupter. The resistor and resistor switching interrupter are connected in series and the series combination connected in parallel with the power interrupter. The resistor switching interrupter includes a hollow rotative gas-conducting crossarm assembly carrying two pairs of moving contacts which cooperate with two pairs of stationary contacts to form four breaks. On an interruption operation, the gas conducting arm is rotated to initiate four arcs and a valve admits high pressure arc-extinguishing gas through the arm and against the arcs.

9 Claims, 8 Drawing Figures

FIG. 7
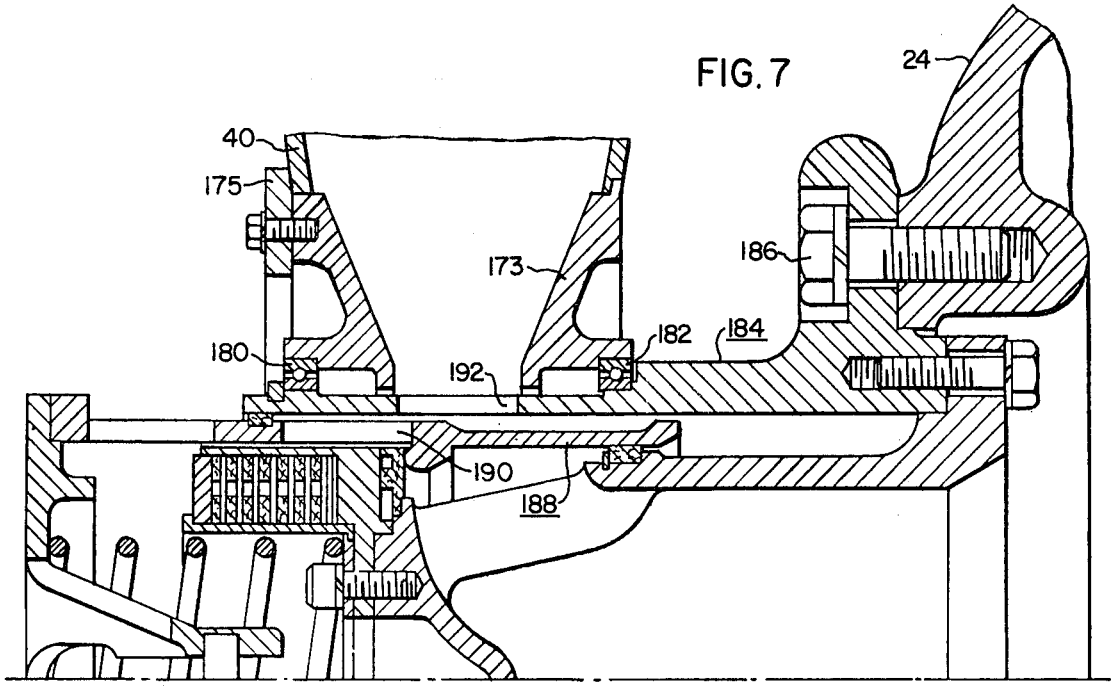
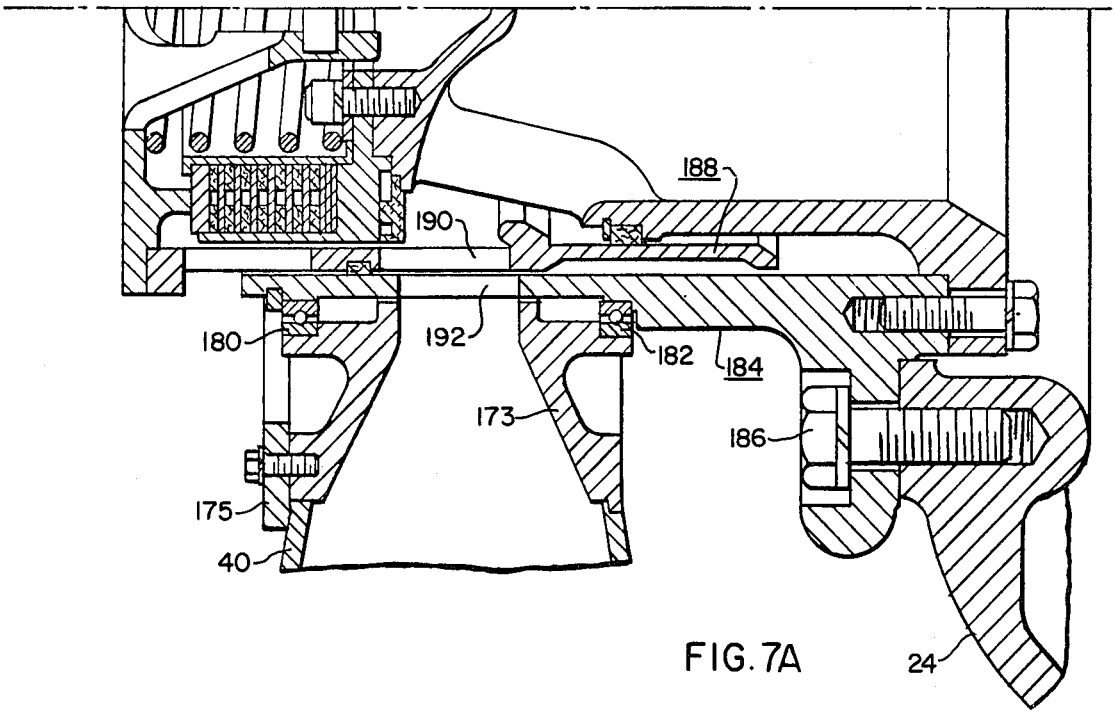
FIG. 7A

FLUID-BLAST CIRCUIT INTERRUPTER

BACKGROUND OF THE INVENTION

1. Field of the Invention

This invention relates to circuit interrupters and more particularly to circuit interrupters employing surge-limiting resistors and to fluid blast circuit interrupters of the high speed type adaptable for multiple break operation.

2. Description of the Prior Art

Transmission networks are used by electric utility companies to carry electrical energy from the point where it is generated to the point where it is ultimately distributed to consumers. System voltages on these transmission networks have been increasing until voltages of 500,000 volts are now common, and voltages of 700,000 volts and above are currently in use or under study. These extremely high voltages present many problems in designing equipment for safely switching components of the transmission network. For example, when an unenergized transmission line is connected to a source of electrical energy at these extremely high voltages, a voltage surge is produced which can have a value of several times the system voltage. Similar surges can occur when an energized transmission line is disconnected from the source. Surges of this magnitude present a stress upon the insulation components of the extra high voltage transmission lines which is even greater than that produced by natural lightning. Thus, it is required that the insulation components be increased in size and capacity to protect against these switching surges. This increases the construction cost of the transmission line.

As is well known in the art, the magnitude of switching surges can be reduced by temporarily inserting a resistor in series with the circuit interrupter. A circuit breaker employing resistors to limit the magnitude of switching surges is described in U.S. Pat. No. 3,291,947 issued Dec. 13, 1966 to the applicant and assigned to the assignee of the present invention. This interrupter employed resistors mounted internally within the housing of the interrupter head. Although the resistors are in series in the electrical circuit for only a fraction of a second, the heat produced by passage of current therethrough is considerable. With the increase in system voltages as previously described, the heat generated by current through the surge limiting resistors is greatly increased. It would thus be desirable in certain applications to provide surge limiting resistance which is external to the interrupting head. It is also desirable to provide means for switching resistance into and out of the circuit to be interrupted at the proper time in the interruption sequence. Since the full available short circuit current will not pass through the resistor and associated switching means, it is desirable to provide cost effective switching means which take advantage of this reduced current while at the same time providing sufficient capability to withstand full system and surge voltages. In order to further reduce the cost of the switching means associated with a surge limiting resistor, it is desirable to provide a high degree of parts commonality with existing circuit interrupters.

In the U.S. Pat. No. 3,590,319, issued June 29, 1971 to Paul Baltensperger, there is disclosed apparatus to switch a surge-attenuating resistance. The apparatus disclosed in the above-mentioned patent is connected in series circuit relationship to the power interrupter.

Thus, the contacts of the apparatus carry full current. It is desirable to provide a system in which the contacts of the resistor switch need only carry a reduced current for a limited time, allowing the use of smaller, lighter components resulting in quicker response due to lower mechanical inertia.

SUMMARY OF THE INVENTION

The invention provides a system for interrupting high voltage circuits, comprising a switching interrupter enclosed in a housing, impedance means external to the housing connected in series with the switching interrupter, a power interrupter connected in parallel with the series combination of the impedance means and the switching interrupter, and sequencing means for closing the switching interrupter prior to closing of the power interrupter on a circuit closing operation and opening the power interrupter prior to opening the switching interrupter on a circuit interruption operation. The switching interrupter comprises a rotating insulating contact crossarm assembly which carries two pairs of movable contacts. The movable contacts cooperate with two pairs of fixed contacts to provide four breaks.

By employing a series combination of impedance means and switching interrupter connected in parallel with the power interrupter, the current flowing through the switching interrupter is negligible while the switching interrupter is closed and is limited by the impedance means to a low value which is carried for only a fraction of a cycle on closing and approximately $1\frac{1}{2}$ cycles on interruption. This limited current flow allows the use of smaller, lighter parts providing quicker action and lower cost. The invention can be constructed to utilize many mechanisms and components suitable for use with an existing interrupter described in U.S. Pat. No. 3,291,947 issued Dec. 13, 1966 to the applicant.

BRIEF DESCRIPTION OF THE DRAWINGS

The invention may be more readily understood when considered in view of the following detailed description of exemplary embodiments thereof, taken with the accompanying drawings, in which:

FIG. 7 is a fragmentary sectional view of the blast valve and support for the rotating contact assembly taken along the line VII—VII of FIG. 5; and FIG. 7A is a view similar to FIG. 7, with the blast valve shown in its open position.

DESCRIPTION OF THE PREFERRED EMBODIMENT

Figure 3:
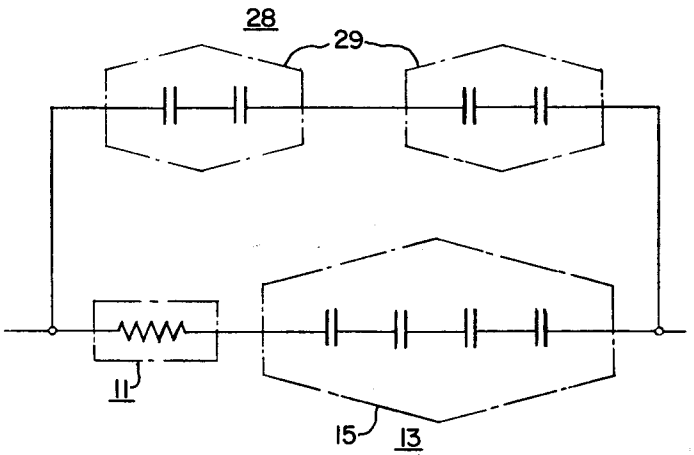
FIG. 3 is a diagrammatic view indicating the position of the several component parts of the circuit interrupter assemblage of FIGS. 1 and 2.

Throughout the drawings, the like reference numerals refer to like elements.

Figure 1:
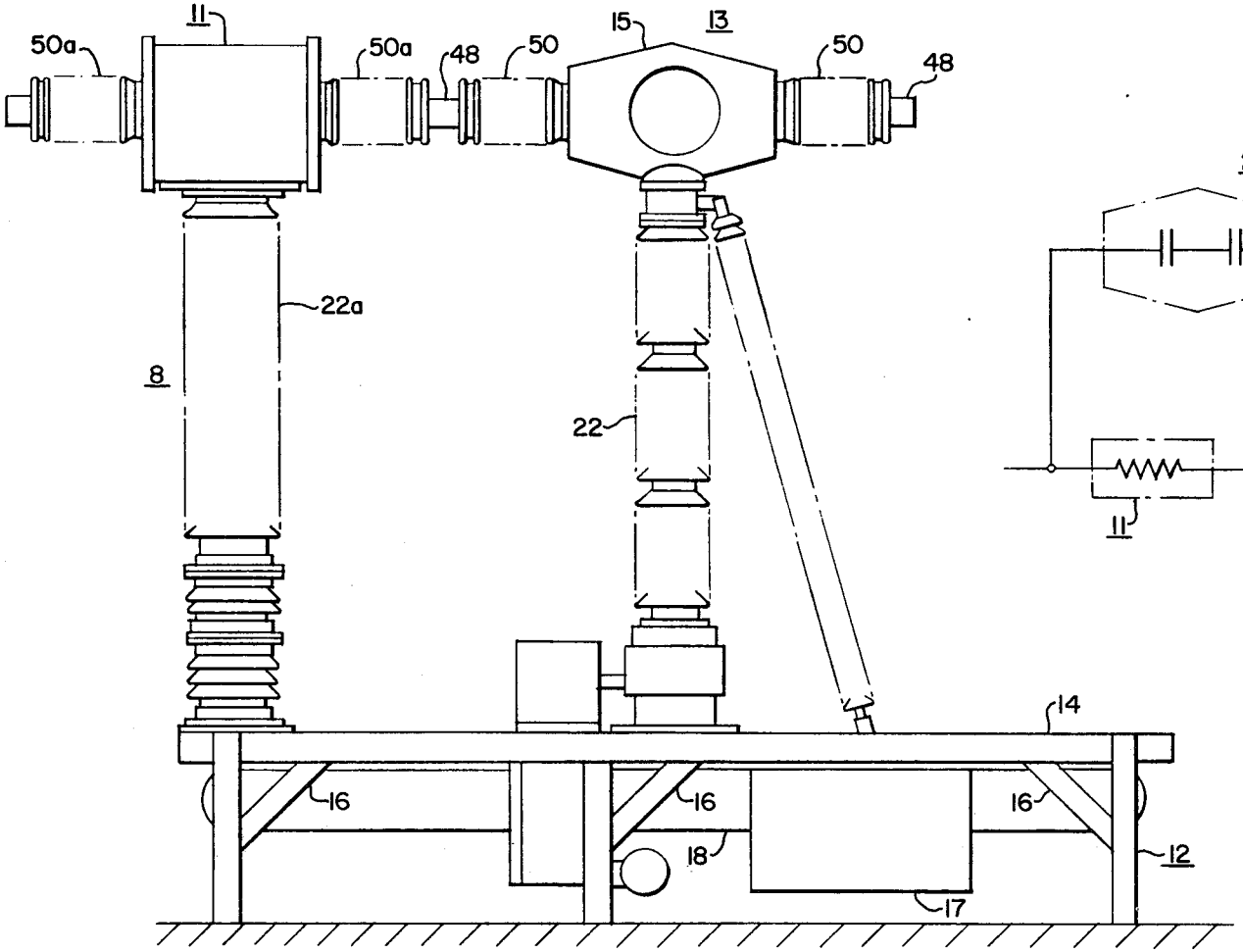
FIG. 1 is a side elevational view of an improved high voltage circuit interrupter assemblage embodying the principles of the present invention.

Referring now to FIG. 1 of the drawings, there is shown a circuit interrupter assemblage 8 including impedance means such as a surge suppressing resistor 11 mounted upon an insulating column structure 22*a*, and a resistor switching interrupter 13. The resistor 11 includes insulating bushings 50*a*. The resistor switching interrupter 13 includes an interrupting head unit 15, which is mounted upon an insulating column structure 22. The column structures 22 and 22*a* are mounted upon a heavy grounded supporting frame 12 comprising heavy longitudinally extending beam members 14 and angular brace supports 16. In addition, each supporting frame 12 preferably has a longitudinally extending high pressure main reservoir tank 18 associated therewith extending in generally parallel relationship, having supply pipes 20 (FIG. 2) extending upwardly therefrom through the column structure 22 to supply high pressure gas to auxiliary high pressure reservoir chambers 24 at high potential, located inside the head units 15, as more particularly described hereinafter.

Figure 2:
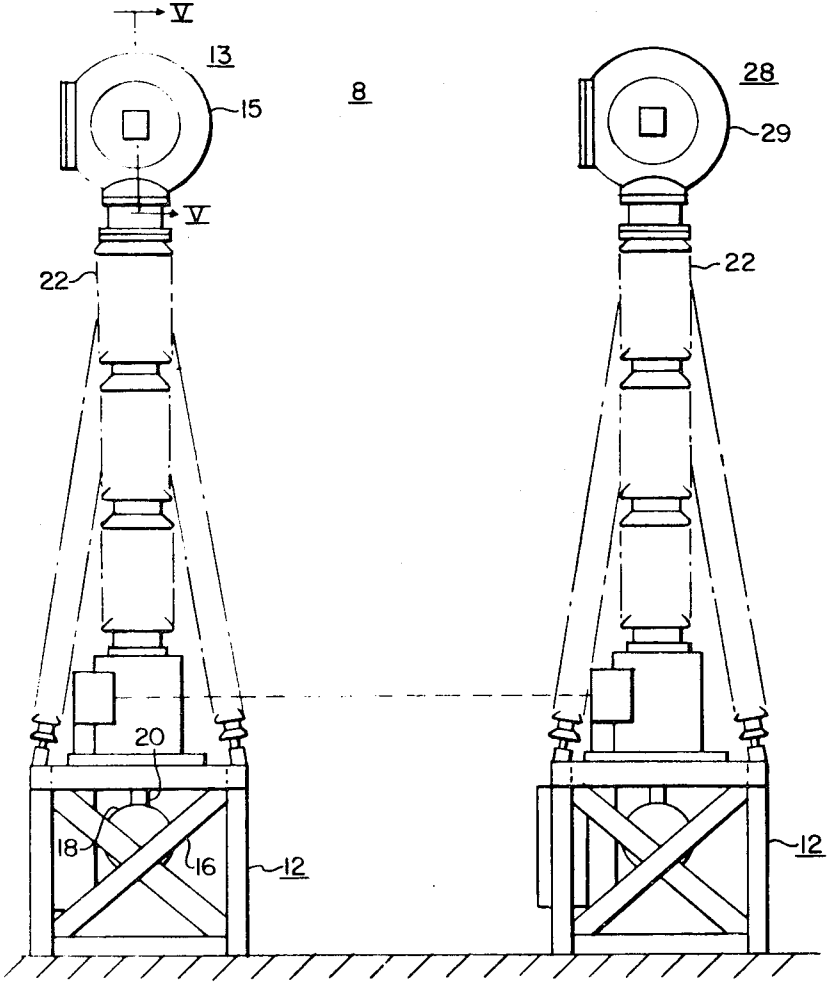
FIG. 2 is an end elevational view of the circuit interrupting assemblage of FIG. 1.

As shown in FIG. 2, the circuit interrupter assemblage 8 also includes a power circuit interrupter 28 having one or more power circuit interrupting head units 29 mounted upon insulating column structures 22. The power circuit interrupting head units 29 are of the two-break type, more particularly described in the aforementioned U.S. Pat. No. 3,291,947. Other types of power circuit interrupting head units could also be used, however.

As is shown in FIG. 3, the resistor switching interrupter head 15 is connected in series with the resistor 11, and the series combination connected in parallel across one or more power interrupting heads 29, the number of which is dependent upon the voltage of the transmission network. For certain applications the resistor switching interrupter 13 may include a plurality of switching interrupter heads 15.

Briefly, the circuit interrupter assemblage 8 performs a closing operation by first closing the resistor switching interrupter 13 and then the power interrupter 28. On an interruption operation, the power interrupter 28 is opened first, followed by the resistor switching interrupter. In this manner, two-step closing and interruption is accomplished, with the resistor being temporarily inserted in series with the circuit being operated on, thereby reducing the magnitude of surge voltages.

Figure 5:
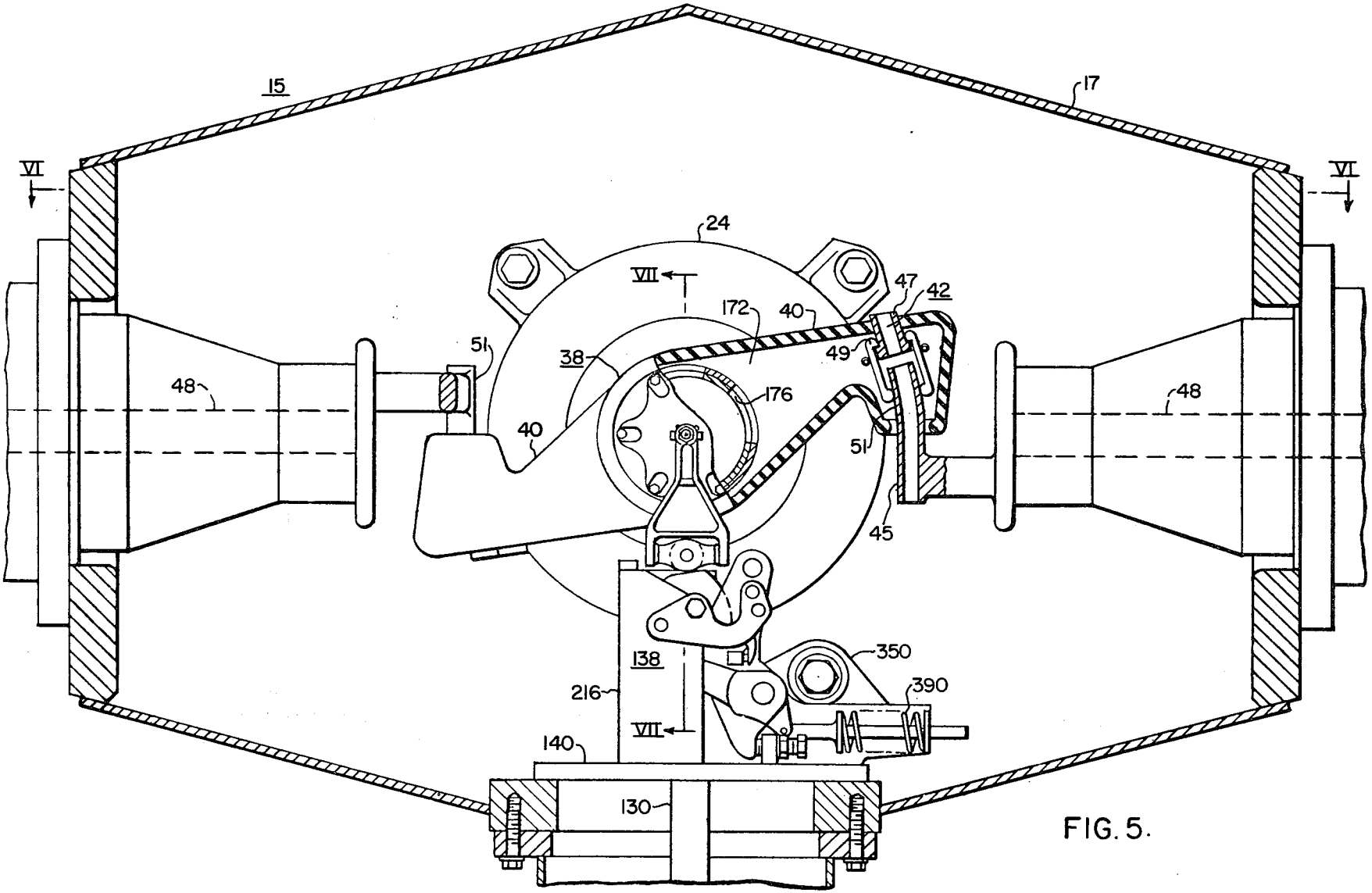
FIG. 5 is a vertical sectional view taken through the resistor switching interrupter substantially along the line V—V of FIG. 2, the contact structure being illustrated in the closed circuit position.
Figure 6:
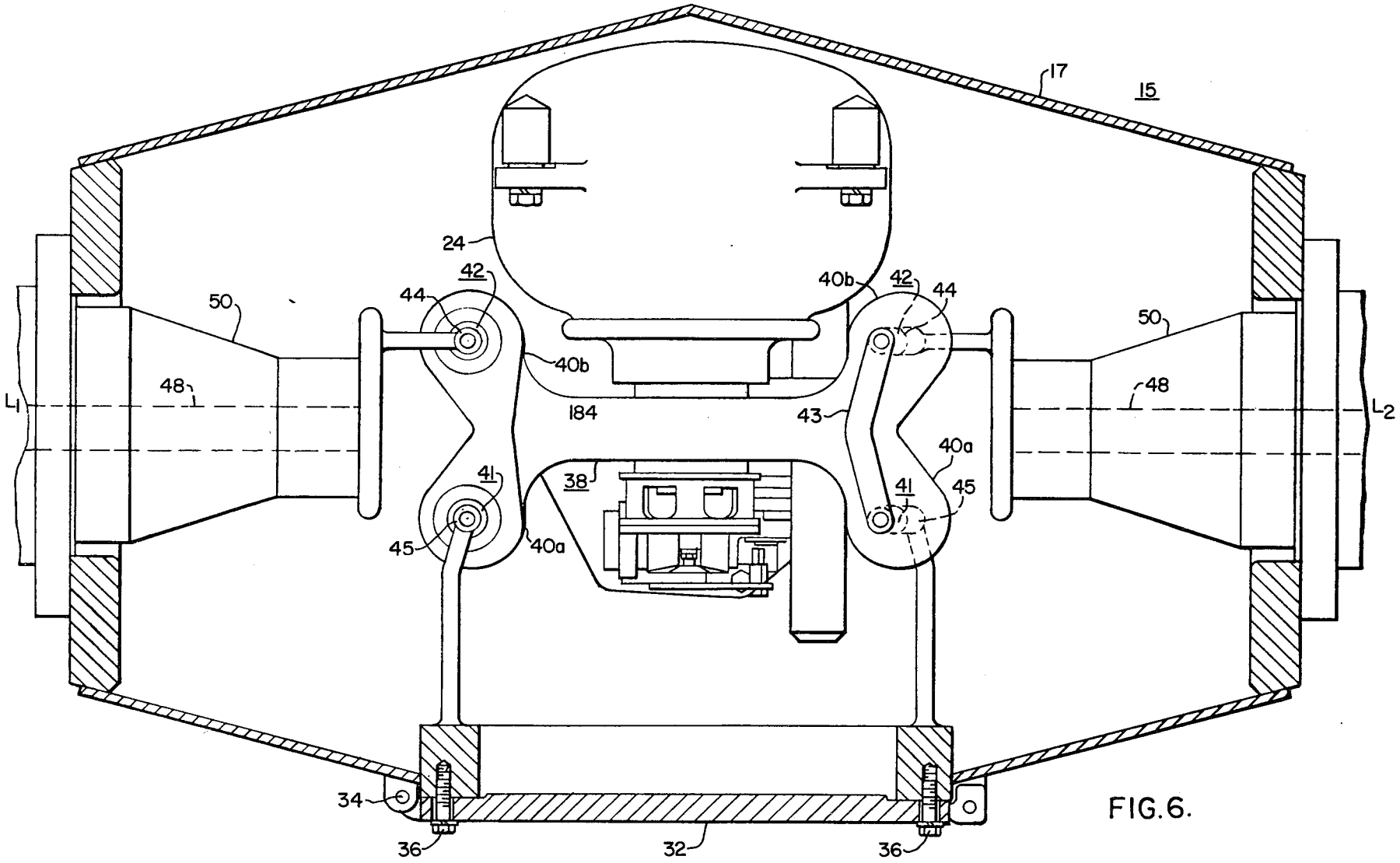
FIG. 6 is a top plan sectional view taken substantially along the line VI—VI of FIG. 5.

Referring to FIGS. 5 and 6, the interrupter head unit 15 includes a live metallic exhaust housing 17 at high potential. An inspection door 32 (FIG. 6), pivotally supported upon hinge pins 34, may be secured by bolts 36, to form a gas-tight closure for the resistor switching interrupter head unit 15.

Located within the housing 17 is a rotating insulating contact crossarm assembly of hollow construction, generally designated by reference numeral 38, which includes a pair of radially outwardly extending gas conducting arms 40, each arm 40 having two laterally extending gas guides 40*a* and 49*b* carrying two movable contacts 41 and 42. The contacts 41 and 42 on each gas guide 40*a* and 40*b* are electrically connected by shunts 43. A pair of stationary contacts 44 is supported upon terminal studs 48 extending through terminal bushings 50, the latter protruding through the ends of the housing 17. A second pair of stationary contacts 45 is supported by and connected to the metallic housing 17. The two contacts 45 are thus electrically connected at all times. As can be seen in FIG. 6, the movable contacts 41 engage the stationary contacts 45 attached to the housing 17 and the movable contacts 42 engage the stationary contacts 44 attached to the terminal studs 48.

The moving contacts 41 and 42 each include a hollow conductive exhaust tube 47 seated in the gas guides 40*a* and 40*b*. Affixed to each exhaust tube 47 is a set of resiliently-biased contact fingers 49 which engage arcing horns 51 of the fixed contacts 44 or 45 when the interrupter head unit 15 is in a closed circuit position. When the interrupter head unit 15 is in a closed position, an electrical circuit is established from the terminal bushing 48 ($L_1$) to the fixed contact 44, through the movable contact 42, the shunt 43, the movable contact 41, and the stationary contact 45, the housing 17, the other stationary contact 45, the movable contact 41, the electrical shunt 43, the movable contact 42, and the stationary contact 44 to the terminal bushing 48 at $L_2$.

For an interruption operation, each movable contact separates from a stationary contact to establish an arc which is extinguished by an intensive gas flow, as more fully described hereinafter. Generally, the resistor switching interrupter head 15 operates, during opening and closing operations, so as to effect rotation of the crossarm assembly 38 to consequently bring about a closing or, alternatively, an interruption of the electrical circuit $L_1L_2$ through the resistor switching interrupter 13.

Figure 4:
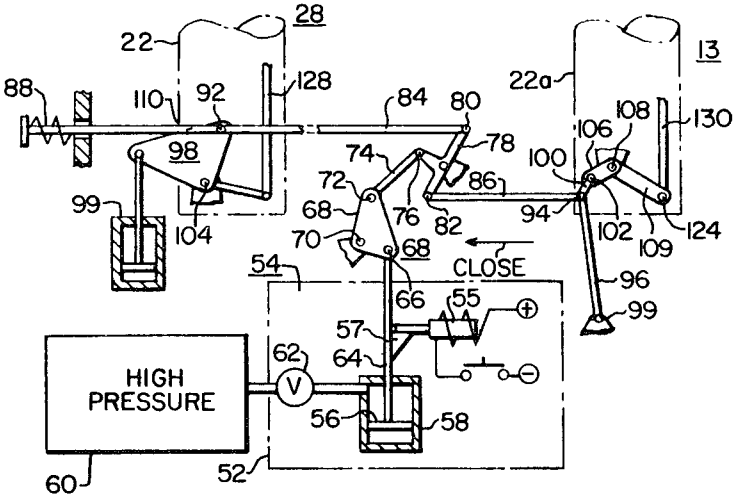
FIG. 4 is a diagrammatic view of the delayed action operating mechanism providing the proper sequence of contact openings.

Referring to FIG. 4 of the drawings, it will be noted that there is provided a mechanism compartment 52 containing a suitable operating mechanism 54. The operating mechanism 54 may be a hydraulic type, pneumatic type, or a solenoid mechanism, as desired. The mechanism 54 is herein illustrated as of a pneumatic type comprising a pneumatic piston 56 reciprocally operable within an operating cylinder 58. The entrance of high pressure gas, such as compressed air, for example, from a reservoir tank 60, as controlled by a closing valve 62, diagrammatically illustrated, effects downward closing movement of the pneumatic piston 56, and hence closing of the power interrupter 28. For multipole installations one such mechanism 54 could be supplied for each pole unit due to the size and weight of the movable parts of the components 15 and 28 which are suitable for 500 KV service at an interrupting capacity of 35,000 MVA. The multiple mechanisms 54 are synchronously controlled by electrical means.

The operating mechanism 54 is such as to effect downward closing movement of an operating rod 64, the latter being pivotally connected as at 66 to a main operating crank 68. The main operating crank 68 is pivotally mounted upon a fixed operating shaft 70. Pivotally connected, as at 72, to this operating crank 68 is a floating link 74, which is also pivotally connected, as at 76, to a double-ended crank arm assembly 78. The double-ended crank arm assembly 78 is pivotally connected as at 80 and 82, to two horizontally extending operating rods 84 and 86. The operating rod 84 has an accelerating spring assembly 88 to supply energy for moving it and the connected linkage to the fully open position. The horizontal operating rod 84 is pivotally connected, as at 92, to a crank arm 98 which is affixed to a horizontally extending main drive shaft 104. The drive shaft 104 rotatably passes through a gas-tight seal in the lower column housing 110 disposed at the lower end of the insulating column structure 22 of the power interrupter 28. Also connected to the crank arm 98 is a dashpot 99 which serves to absorb energy at the end of the opening operation.

The operating rod 86 is pivotally connected as at 94 to a control arm 96 pivotally mounted upon a fixed pivot pin 99. The operating arm 86 is also pivotally connected as at 94 to a floating link 100, the other end of which is pivotally connected as at 102 to an arm 106. The crank arm 106 is pivotally mounted upon a fixed operating shaft 108 which extends into the interior of the column 22*a.* The shaft 108 operates an arm 109 which is pivotally connected as at 124, to the lower end of a vertically extending and reciprocally moving insulating operating rod 130.

To initiate an interruption, the trip solenoid 55 is energized, releasing the latch 57. Opening bias supplied by the spring 88 and torsion assemblies (to be described hereinafter) causes the operating rod 84 to be driven to the left in FIG. 4 and the operating rod 86 to be driven to the right. Due to the action of the floating link 100 and arms 106 and 109, the insulating operating rod 128 is allowed to move upward before the arm 130 is allowed to move downward. Thus, the contacts of the power interrupter 28 are operated approximately 1½ cycles prior to the contacts of the resistor switching interrupter 15 on an interruption operation.

During a closing operation, the mechanism 54 is actuated as previously described. In a similar manner, the operation of the floating link 102 and arms 106 and 109 act to provide for downward closing action of the insulating operating rod 130 prior to downward closing movement of the operating rod 128. Thus, the contacts of the resistor switching interrupter 15 are closed a fraction of a cycle before the contacts of the power interrupter 28 on a closing operation.

As shown more clearly in FIGS. 5 and 7 of the drawings, the rotatable crossarm assembly 38 includes a metallic hub 173 having bearings 180, 182 (FIG. 7) to rotatably support the crossarm assembly 38 on an apertured bearing and blast valve support generally designated by the reference numeral 184. The crossarm assembly 38 includes insulating arms 40 secured to the hub 173 by retaining rings 175. The apertured bearing support 184, as shown in FIGS. 7 and 7A, is fixedly secured by bolts 186 to the auxiliary reservoir chamber 24. During the opening operation, opening of a cylindrically shaped blast valve 188 to the position shown in FIG. 7A will permit the blasting of high pressure arc-extinguishing gas, such as sulfur hexafluoride ($SF_6$) gas from the auxiliary gas reservoir 24, out through openings 190 provided in the side guide wall portion of the blast valve 188, and through openings 192 provided in the bearing and blast valve support 184, through the gas conducting arms 40 and toward the gas guides 40*a* and 40*b,* and intercontact region to effect extinction of the established arc. The reservoir 24, bearing and blast valve support 184, and blast valve 188 are of the type more fully described in the aforementioned U.S. Pat. No. 3,201,947.

To obtain a high initial opening acceleration for the crossarm assembly 38 thereby providing high speed operation of the resistor switching interrupter head unit 15, there is provided an accelerating-spring torsion-bar assemblage, generally designated by the reference number 350 in FIG. 5. This spring assemblage is secured to a mounting plate 140 attached to the housing 17. The spring is charged by the downward closing movement of the operating rod 130. To insure that the rotative moving contact assemblage 38 will move completely to the fully open circuit position upon interruption, there is additionally supplied a biasing spring assemblage 390, also secured to the mounting plate 140. An operating linkage 138 is provided to effect rotation of the crossarm assembly 38 and actuation of the blast valve 188 when the torsion bar assemblage 350 and biasing spring assemblage 390 are operated by action of the operating rod 130. The net result is that during the initial portion of the interruption operation, the torsion bar assemblage 350 provides a high initial opening force, which is augmented by the biasing spring 390 acting through the entire stroke to insure full contact separation. The operating linkage 138, torsion bar assemblage 350, and biasing spring assemblage 390 are also of the type more fully described in the aforementioned U.S. Pat. No. 3,201,947.

Generally, the compressed gas resistor switching interrupter 13 of the present invention can be used with any suitable high pressure gas. Preferably, however, it is desired to use a highly efficient gas, such as sulfur hexafluride ($SF_6$) gas, which may be at a high pressure of, for example, 240 p.s.i.g. The exhaust tank pressure, as present within the exhaust housing 17 and within the insulating column structure 22 will be at approximately 45 p.s.i.g. As is usual with such types of interrupters, preferably a compressor 17 (FIG. 1) is supplied to effect recompression of the low pressure $SF_6$ gas to the requisite high pressure level, at which it is stored within the longitudinally extending main reservoir tank 18. As previously mentioned, a supply pipe 20 connects the main reservoir tank 18 with the auxiliary reservoir tank 24.

Prior to an interruption operation, the power interrupter heads 29 are closed and the resistor switching interrupter head unit 15 is in the position shown in FIGS. 5 and 6. To effect an interruption operation, the synchronizing mechanism 54 is actuated and, as previously described, the operating rod 128 of the power interrupter 28 is moved in an upward direction, thereby opening the two breaks of the power interrupter head unit 29. Subsequently, the operating rod 130 of the resistor switching interrupter 15 is moved in an upward direction. This releases the acceleration spring torsion bar assemblage 350 (FIG. 5) causing a high initial opening force to be applied to the operating linkage 138. The operating linkage 138 causes the crossarm assembly 38 to rotate rapidly in a counterclockwise direction as seen in FIG. 5. Four arcs are thus established, one between each of the contact finger sets 49 and the fixed contacts 44 and 45. Simultaneously, the operating linkage 138 actuates the blast valve 188 from the closed position as seen in FIG. 7 to the open position as seen in FIG. 7A, thereby permitting the flow of high pressure arc-extinguishing gas from the auxiliary reservoir 24 outward through the gas conducting arms 40 and gas guides 40*a* and 40*b* against the established arcs. The gas flows into the interior of the hollow exhaust tubes 47 and arcing horns 43, and exhausts into the space defined by the interior of the housing 17. Action of the biasing spring assemblage 390 causes the crossarm assembly 38 to rotate the full extent of its travel, permitting the extinction of the four established arcs by the action of the high pressure sulfur hexafluoride gas.

On a closing operation, the synchronizing mechanism 54 effects downward closing movement of the operating rod 130 of the resistor switching interrupter 15. This causes, through action of the operating linkage 138, clockwise rotation of the crossarm assembly 38 to the position shown in FIG. 5 and charges the accelerating spring torsion bar assemblage 350 and bias spring assemblage 390. A closed circuit is thus established between $L_1$ and $L_2$ in the resistor switching interrupter 15, thereby inserting the resistor 11 in series with the circuit being controlled. The synchronizing mechanism 54 then effect downward closing movement of the operating rod 128, thereby closing the power interrupter 28 and shorting out the resistor 11, permitting full circuit current to flow through the power interrupter.

The present invention provides for insertion of resistance of a circuit interrupter system during closing and interruption operations. By providing a series combination of a resistor and a resistor switching interrupter, the series combination in parallel with a power interrupter, the invention provides for reduced current flow through the resistor switching interrupter. The resistor switching interrupter head 15 is thus able to use smaller, lighter contacts and provide four breaks within a single housing. The resistor switching interrupter 13 can also be used to switch impedances other than a resistor, or by itself in certain applications requiring a high-speed multiple break circuit interrupter.

In conclusion, there results a circuit interrupter system of extremely high speed operation which provides switching of surge-limiting resistance external to the interrupter head units. A minimum number and weight of moving parts are associated with the crossarm assembly 38. A high degree of parts commonality with existing power interrupters is provided in the resistor switching interrupter head unit while providing four breaks within a single housing, thus reducing cost of the total system.

Although there has been illustrated and described specific structures, it is to be clearly understood that they are for the purpose of illustration and that changes and modifications may be readily made therein by those skilled in the art without departing from the spirit and scope of the invention.

I claim:

1. A multiple break circuit interrupter having open and closed positions, comprising:

an upstanding insulating column;

a housing supported upon said column;

a pair of terminal bushings extending into said housing;

a hollow insulating arm rotatively mounted within said housing and having two ends;

a plurality of stationary contact pairs supported within said housing;

a plurality of movable contacts mounted upon each of said arm ends, each of said movable contacts being cooperable with one of said stationary contacts to establish an arc when said circuit interrupter is operated from the closed position to the open position.

2. A multiple break circuit interrupter as described in claim 1 wherein each of said arm ends comprises a plurality of laterally extending gas guides, each of said gas guides supporting one of said movable contacts.

3. A multiple break circuit interrupter as described in claim 2 wherein each of said arm ends comprises two gas guides, each of which support one of said movable contacts, and each of said arm ends further comprises a conducting shunt connecting said two movable contacts supported on each arm end.

4. A multiple break circuit interrupter as described in claim 3 comprising first and second pairs of stationary contacts, said first pair being supported upon said housing, said second pair being electrically connected together.

5. A multiple break circuit interrupter as described in claim 4 wherein said housing is constructed of conductive material, said first pair of stationary contacts is electrically insulated from said housing and said second pair of stationary contacts is electrically in contact with said housing.

6. A system for interrupting high voltage circuits, comprising:

a switching interrupter enclosed in a housing, said switching interrupter comprising a four-break interrupter having four moving contacts and a hollow rotatable crossarm assembly carrying said movable contacts;

impedance means external to said housing connected in series with said switching interrupter;

a power interrupter connected in parallel with the series combination of said impedance means and said switching interrupter; and sequencing means for closing said switching interrupter prior to closing said power interrupter on a circuit closing operation and opening said power interrupter prior to opening said switching interrupter on a circuit interruption operation.

7. A system as described in claim 6 wherein said power interrupter comprises a plurality of power interrupter head units, each head unit comprising one or more breaks.

8. A system as described in claim 7 wherein said switching interrupter housing comprises a conductive shell, and said system further comprises a first pair of stationary contacts each supported upon an insulating bushing within said shell and a second pair of stationary contacts supported upon said shell and being electrically connected together.

9. A system as described in claim 6 wherein said switching interrupter comprises a plurality of switching interrupter head units, each of which comprises one or more breaks.

* * * * *